United States Patent [19]

Anderson

[11] Patent Number: 4,856,616

[45] Date of Patent: Aug. 15, 1989

[54] RAILING SUPPORT CLAMP FOR SCAFFOLD

[76] Inventor: Carl Anderson, c/o Alum-A-Pole Corporation, 2589 Richmond Ter., Staten Island, N.Y. 10303

[21] Appl. No.: 215,245

[22] Filed: Jul. 5, 1988

[51] Int. Cl.[4] ..... E04G 1/26

[52] U.S. Cl. ..... 182/113; 248/72; 248/231.4; 248/228; 256/DIG. 6

[58] Field of Search ..... 182/113, 82; 248/228, 248/72, 231.4; 256/DIG. 6

[56] References Cited

U.S. PATENT DOCUMENTS

| | | | |
|---|---|---|---|
| 1,055,345 | 3/1913 | McMahon | 248/228 |
| 1,564,703 | 12/1925 | Nichols | 248/228 |
| 2,195,955 | 4/1940 | Hillenbrand | 248/72 |
| 2,208,358 | 7/1940 | Chandler | 248/72 |
| 2,233,911 | 3/1941 | Carson | 248/228 |
| 2,736,527 | 2/1956 | Maier | 248/228 |
| 3,053,494 | 9/1962 | Stoll | 248/228 |
| 3,396,851 | 8/1968 | Buckner | 248/228 |
| 3,480,257 | 11/1969 | Bourn | 182/113 |
| 3,938,619 | 2/1976 | Kurabayashi | 182/113 |
| 4,620,612 | 11/1986 | Enoki et al. | 182/113 |

*Primary Examiner*—Reinaldo P. Machado
*Attorney, Agent, or Firm*—Helfgott & Karas

[57] ABSTRACT

An adjustable clamp for supporting guard rails or the like or an I-beam side rail of a scaffold system comprises lipped flange members designed to overlap the inner edges of end flanges of the I-beam side rail. The flange members each have a U-shaped outward extension and the extensions are joined together by a web means which is adjustable to permit the flange members to engage both I-beam end flanges snugly. A fastening means passes through the web means and bears against the web of the I-beam. Apertures which pass through the flange members serve to securely support posts for a guard rail or the like.

13 Claims, 4 Drawing Sheets

RAILING SUPPORT CLAMP FOR SCAFFOLD

RELATIONSHIP TO OTHER APPLICATIONS AND PATENTS

This invention relates to the following issued patents and pending U.S. patent applications, all by the inventor of the present application: U.S. Pat. Nos. 4,382,488 issued May 10, 1983 for PUMP JACK POLES; 4,432,435 issued Feb. 21, 1984 for CLAMPING DEVICE; 4,446,945 issued May 8, 1984 for BRACE FOR SECURING A POLE TO A SUPPORT SURFACE; 4,463,828 dated Aug. 7, 1984 for PUMP JACK; 4,499,967 issued Feb. 19, 1985 for SCAFFOLDING STAGING; 4,598,784 issued July 8, 1986 for SCAFFOLDING SYSTEM; 4,624,342 issued Nov. 25, 1986 for SCAFFOLDING PLATFORM; and pending U.S. patent application (9017), filed Feb. 26, 1988, Ser. No. 160,656 for SCAFFOLDING NET SYSTEM.

BACKGROUND OF THE INVENTION

This invention relates to scaffolding equipment and, in particular, to fastening devices for attaching safety railings, associated panels and/or nets to scaffold platforms.

In my U.S. Pat. No. 4,624,342 and in my pending Patent Application No. (9017) referred to above, certain types of safety arrangements are described for use where scaffold platforms are provided at two or more levels on a given set of vertical supports, and specifically on pump jacks which are supported on pump jack poles.

A primary concern in those configurations, as well as in the case of the present invention is to provide devices to improve the safety of workers and equipment while they are aloft on scaffold platforms.

In the case of the present invention, it is a particular objective to provide adequately stable and sturdy supports for guard rails, panels and/or personnel retaining devices along the edges of scaffold platforms.

It is also an objective to provide such supports which are easily installed on a variety of different sized scaffold support beams.

It is a still further objective to provide such supports which readily may be positioned at desired locations along scaffold support beams.

SUMMARY OF THE INVENTION

In accordance with one aspect of the present invention, there is provided a support clamp for a safety rail or similar device which is adapted for mounting on an I-beam having two end flanges and a connecting web. The support clamp comprises first and second substantially parallel flange members adjustably spaced apart from each other. Each flange member has a beam engaging lip at one end which is adapted to engage an end flange of the I-beam.

A web means is coupled between edges of the flange members remote from their respective beam engaging lips and an adjusting means is coupled to the web means for permitting movement of the flange members together with the beam engaging lips away from and toward each other so as to facilitate engagement with the I-beam.

A fastening means extends through the web means and is adapted to engage the web of the I-beam so as to cause the lips to bear against the end flanges of the I-beam. A safety rail receiving means is provided in at least one of the flange members for supporting the safety rail in relation to the I-beam.

The adjusting means according to an embodiment is formed by a hinge mounted between the web means and one of the flange members to permit movement of the flange members away from and toward each other so as to facilitate engagement with the I-beam.

In an embodiment, two bumps or protrusions are provided on the internal surface of one of the flange members so that the ends of hollow posts passing through another flange member are supported on the protrusions to further assist to stability of the assembly.

DETAILED DESCRIPTION OF THE INVENTION

Figure 1:
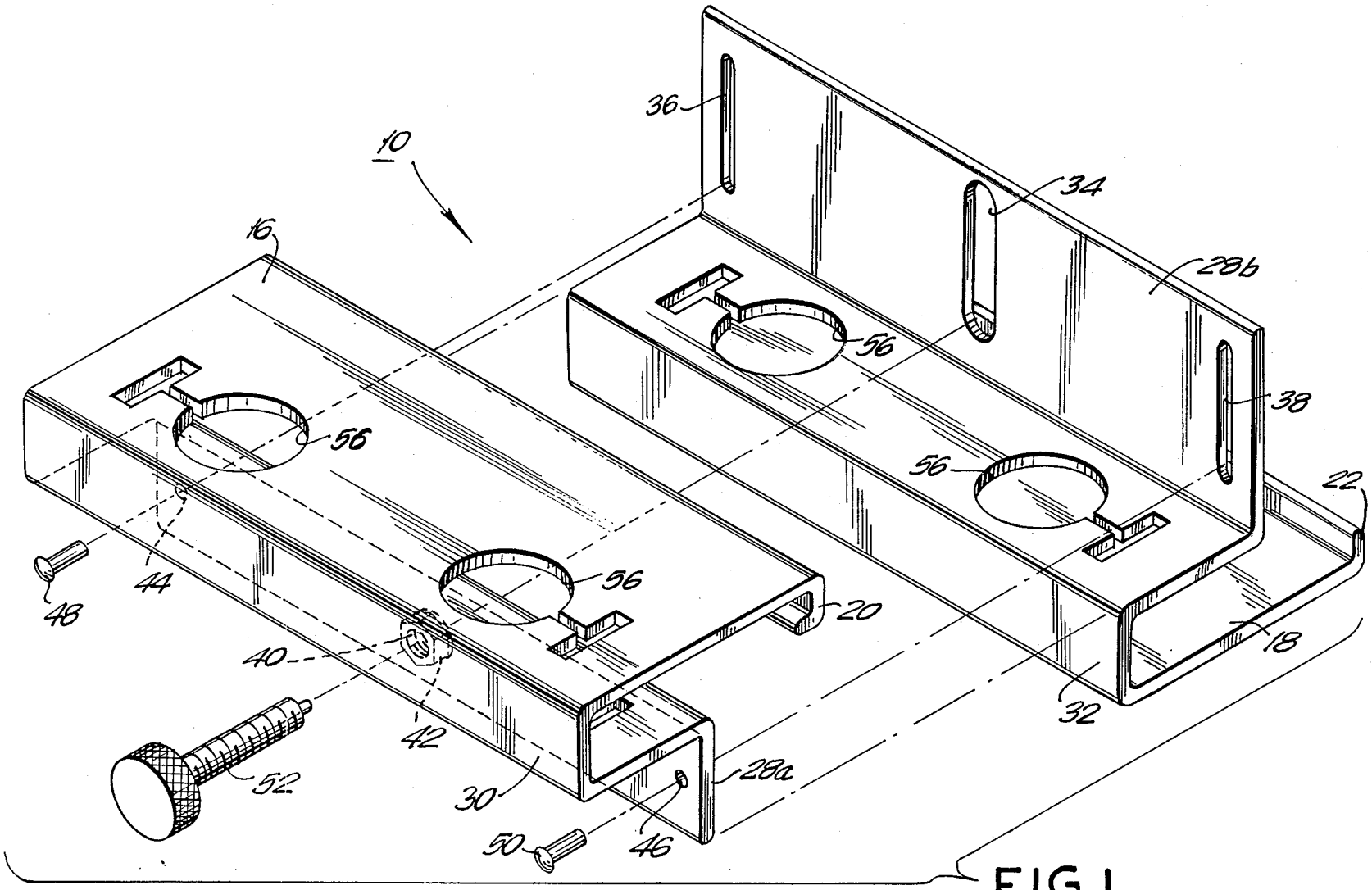
FIG. 1 is an exploded perspective view of a clamping arrangement constructed in accordance with the present invention for fastening a safety rail or the like to a scaffold platform.
Figure 2:
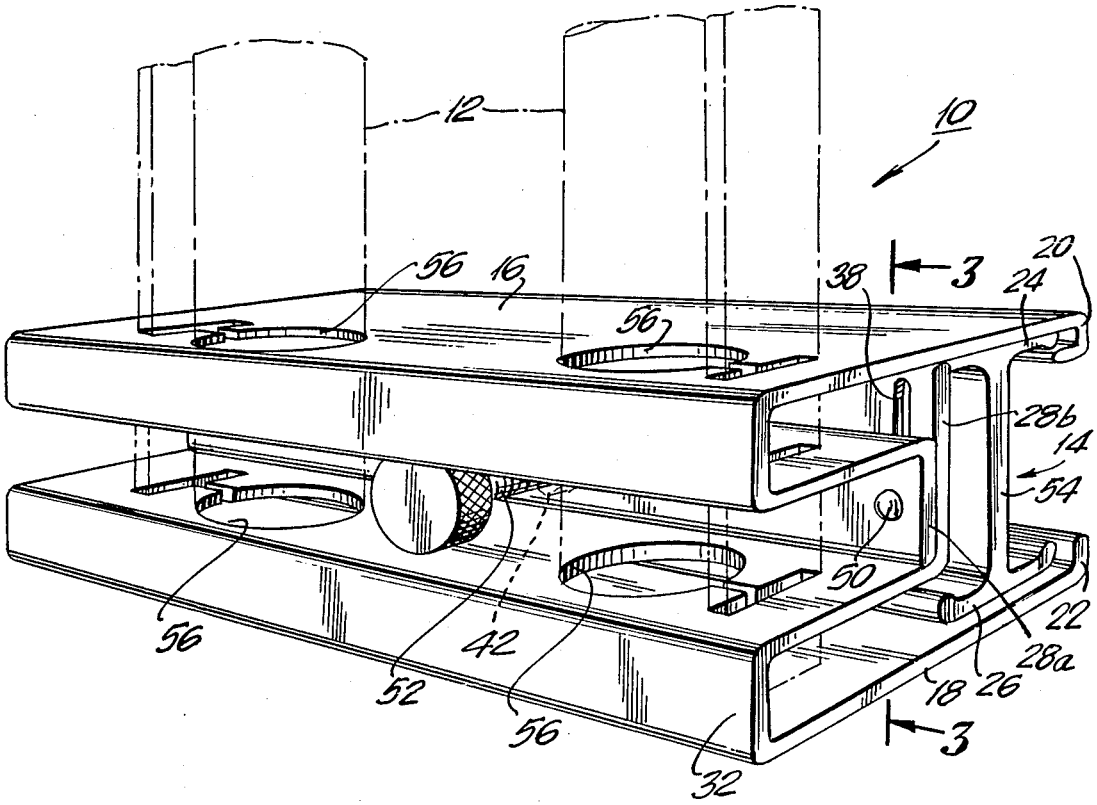
FIG. 2 is an assembled perspective view of the clamping arrangement of FIG. 1 mounted on an I-beam side rail of a scaffold platform.
Figure 3:
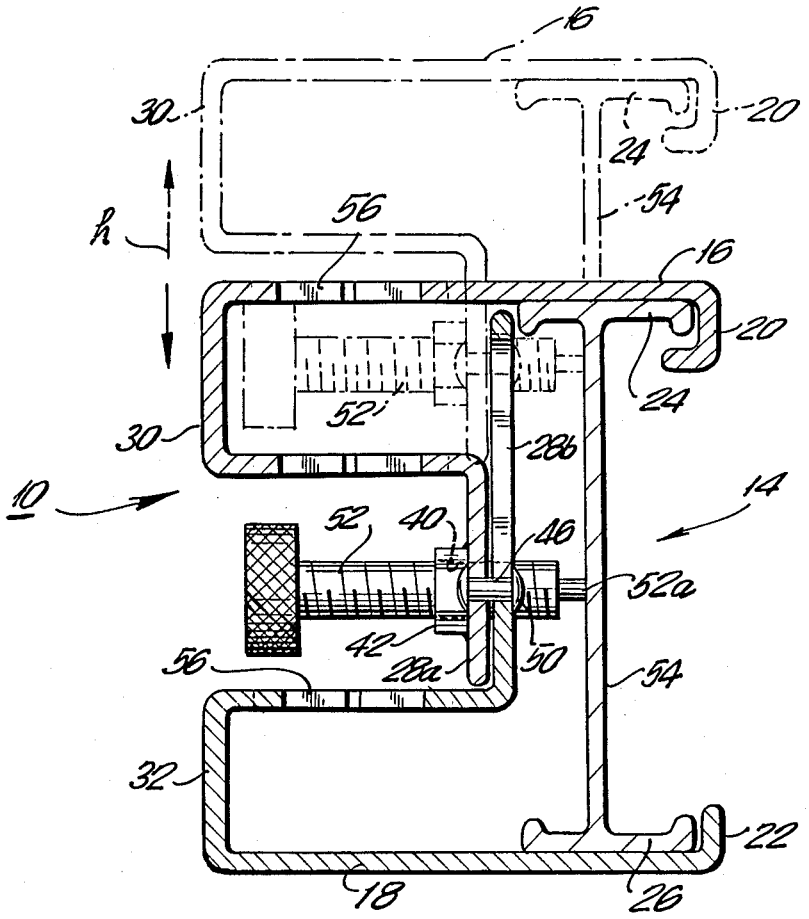
FIG. 3 is a sectional view taken along the lines 3—3 in FIG. 2 in the direction of the arrows illustrating the manner in which the clamping arrangement of FIG. 1 is adjustable.

Referring to FIGS. 1–3 of the drawings, a support clamp, indicated generally by the reference number 10, is shown which is suitable for mounting a safety rail or a similar device on a scaffold stage or platform. Suitable support posts 12 (shown partially in FIG. 2) for a safety rail are associated with support clamp 10. By way of example the rails 12 can project from the clamp 10.

Support clamp 10 is particularly adapted for mounting on the outside of an 1-beam side rail 14 of a platform of the type shown, for example, in my above-noted U.S. patents and pending application.

Support clamp 10 comprises a first or upper flange member 16 and a second or lower flange member 18 which are substantially parallel to each other and are spaced apart by a distance at least equal to the outside height dimension of the associated I-beam 14.

Each of flange members 16 and 18 has a beam engaging lip 20, 22, respectively, at the inner extremity of the flange members 16, 18. The lips 20, 22 are substantially perpendicular to the respective flange members 16, 18 and are adapted to engage the innermost edge of an end flange (24, 26, respectively) of I-beam 14.

At least one of the beam engaging lips (20 in the illustrated case) comprises an L-shaped member which is adapted to wrap around the flange 24 of I-beam 14.

A web means 28 comprising first and second separate pieces **28*a* and 28*b* is coupled between the flange members 16 and 18 by means of generally U-shaped extensions 30 and 32 which project from flange members 16 and is in an outward direction relative to 1-beam 14**.

As shown in FIG. 1, web piece **28*b* is upstanding relative to I-beam 14, while web piece 28*a*** may be characterized as depending.

Upstanding web piece **28*b* is relatively greater in height than depending web piece 28*a***, but that relationship may be changed as will be apparent hereinafter.

Upstanding web piece 28b is provided with a relatively wide, vertically oriented central slot 34 and two relatively narrow, vertically oriented slots 36 and 38 disposed one to each side of central slot 34. Depending web piece 28a is provided with a relatively large central aperture 40, also passing through a threaded member 42, and two relatively smaller side apertures 44 and 46. Threaded member 42 may be formed integrally with web piece 28a or, as is shown, may comprise a threaded nut welded to web piece 28a.

The web pieces 28a and 28b are arranged to be fastened together in overlapping, adjustable relationship (see FIGS. 2 and 3) by means of rivets 48, 50. Rivet 48 is slidably fastened through aperture 44 and slot 36 while rivet 50 is slidably fastened through aperture 46 and slot 38. The web portions 28a and 28b are retained in relatively close proximity to each other by rivets 48 and 50, but are nevertheless relatively adjustable in a vertical direction as indicated in FIG. 3 by arrows h. One means of achieving the desired "captivated" but slidable relationship between web pieces 28a and 28b is to roll over the ends of rivets 48 and 50 only partially.

A fastening means shown as a threaded shaft or bolt 52, passes through similarly threaded member 42 in depending web piece 28a. The inner end 52a of bolt 52 engages one surface of a web 54 of I-beam 14.

Apertures 56 are provided through both horizontal portions of U-shaped extension 30 and at least through the upper one of the horizontal portions of U-shaped extension 32 in order to receive support posts 12 for a safety rail or the like.

In the use of the support clamp 10, the bolt 52 is retracted to a position (see full line showing in FIG. 3) so as to provide clearance between its inner end 52a and the Web 54 of an associated I-beam 14. The upper flange member 16 is placed over the upper flange 24 of the I-beam 14 such that L-shaped lip 20 engages the innermost edge of flange 24. The clamp 20 may then be adjusted by moving the lower flange member 18 upwardly into engagement With lower flange 26. Bolt 52 is then advanced inwardly towards web 54 of I-beam 14. After the end 52a contacts web 54 and the bolt 52 is advanced further, the lips 20 and 22 will be drawn snugly against the innermost edges of flanges 24 and 26, thereby securing clamp 20 to I-beam 14.

Posts 12 may then be inserted into apertures 56 to provide a sturdy foundation for the associated rail (not shown) enhanced by the support provided by U-shaped extensions 30, 32.

It should be recognized that the height of upstanding web 28b determines in large part both the minimum and maximum heights of suitable I-beam 14 with which clamp 10 may be employed. Furthermore, the distance between lip 22 and upstanding web member 28b will determine the maximum size of I-beam flange 24, 26 with which the clamp 10 may be employed. However, it can readily be seen that a relatively wide range of I-beam sizes may be accommodated utilizing the arrangement of FIGS. 1-3. The dimensions of the legs of U-shaped extensions 30 and 32 are selected according to the size of the associated support posts 12 for a safety rail or the like. The spacing between parallel legs of the U-shaped extensions 30, 32 is selected to provide stable support for the posts 12.

The apertures 56 for posts 12 are configured to provide a relatively close fit around the posts 12. A particularly advantageous "O-I" shape for the apertures 5s is illustrated. Further details of that shape are described in my U.S. patent application Ser. No. 215,245 which is filed concurrently with this application. As is shown in each of FIGS. 1 and 2, the "I" (or more accurately, the "T") shaped portion of each of the apertures 56 is remote from the center of the U-shaped extensions 30, 32. That is, the "O" shaped portion of the apertures 56 lies closer to the center of extensions 30, 32. As is described in greater detail in my concurrently filed application, such an arrangement makes it possible to provide a particularly advantageous handrail (not shown) on the safety rail associated with posts 12. It also permits locking of the posts 12 in place to avoid relative rotation of the posts 12 within the clamp.

Figure 4:
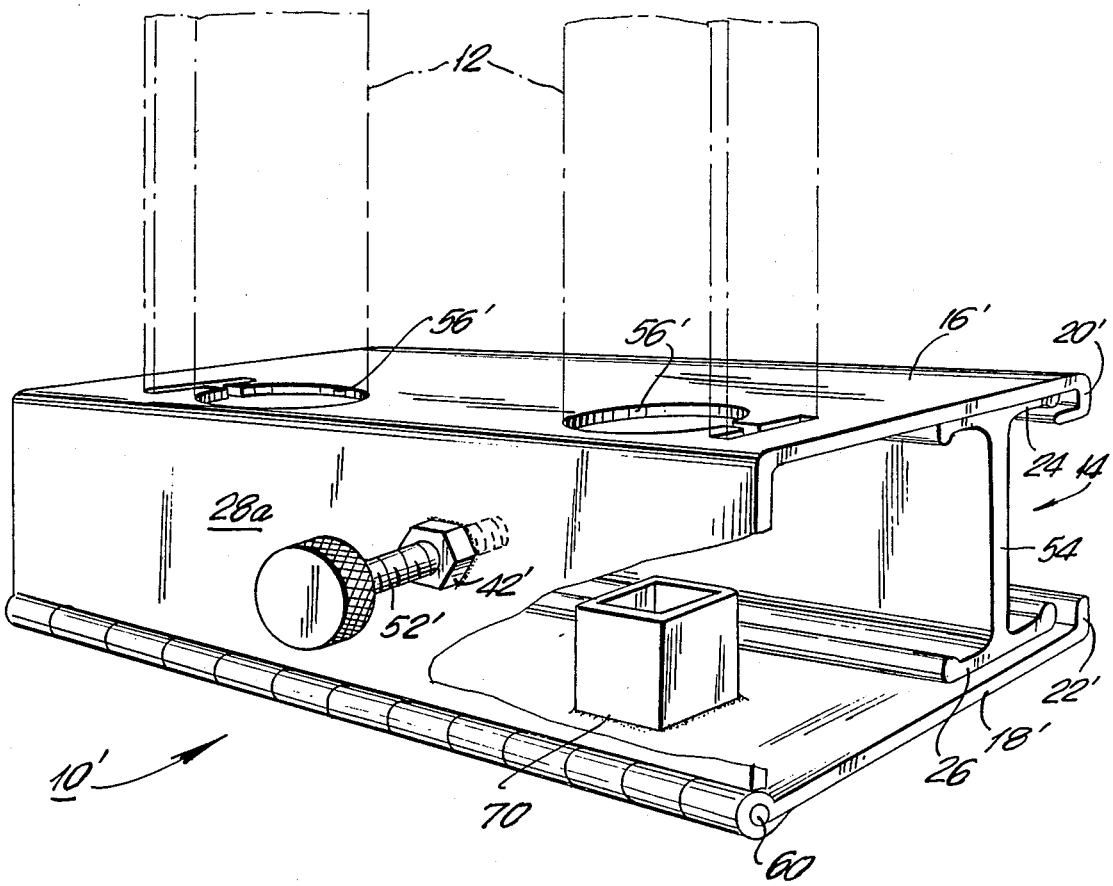
FIG. 4 is a perspective view of an alternate embodiment of the present invention.

Referring to FIG. 4, a modified clamp arrangement constructed in accordance with the present invention is shown. This alternate arrangement typically is used in connection with light duty scaffolds. In the FIG. 4 embodiment, the upper flange member 16' is shown connected directly to web means 28a'. The lower flange member 18, is connected to the lower end of web member 28a, by means of a hinge 60. The innermost end of flange member 16' is provided with a lip 20, for engaging one flange 42 of an associated I-beam rail 14. Similarly, the innermost end of flange member 18' is provided with a lip 22, for engaging the other flange 26 of the I-beam rail. A threaded bolt 52' and an associated threaded aperture 42' through web member 28a' are provided in a manner similar to the embodiment of FIGS. 1-3 to fasten the clamp arrangement 10' to an I-beam rail.

Properly shaped apertures 56, are provided in flange member 16' to receive posts 12. The clamp arrangement 10' is fastened to an I-rail of matching dimensions by backing bolt 52' out of threaded aperture 42', engaging the upper flange member 16, while hinge 60 is open, swinging lower flange member 18' upward to engage the lower flange 26 of the associated I-beam, then advancing bolt 52' until its end 52a' contacts the web 54 of the associated I-beam and finally, advancing bolt 52' further until the lips 20 ' and 22' snugly engage the corresponding flanges of the I-beam.

The lower flange member 18' is provided with two hollow post-like bumps or protrusions 70 (only one is shown in FIG. 4), each projecting upwardly from the internal wall of the lower flange member. Hollow protrusions 70 may be made integrally with the flange member 18 or may be welded thereto. Each protrusions 70 receives thereon the O-shaped portion of the post 12 which passes through the respective aperture 56 inwardly of the clamp arrangement 10'. Protrusions or bumps 70 provide a reliable and sturdy support for the lower ends of posts 12 resting on the inner surface of the lower flange member 18' of the clamp arrangement 10'.

While the invention has been described in terms of one or more preferred embodiments, it will be apparent to persons familiar with this art that various modifications may be made without departing from the scope of the invention which is set forth in the following claims.

What is claimed is:

1. A support clamp for a safety rail or similar device adapted for mounting on a beam having two end flanges and perpendicular connecting web, the clamp comprising:

first and second substantially parallel flange members spaced apart from each other, each said flange member having a beam engaging lip at one extremity thereof adapted to engage an end flange of said beam;

web means coupled between extremities of said flange members remote from their beam engaging lips;

adjusting means coupled to said web means for permitting movement of said beam engaging lips away from and toward each other so as to facilitate engagement of said lips with said beam flanges;

fastening means extending through said web means and adapted to engage the web of said beam so as to cause the end flanges of said beam to bear against at least one of said lips and thereby fasten said support clamp to said beam; and post receiving means in at least one of said flange members for supporting a post in upright relation and adjacent to said beam.

2. A support clamp for a safety rail or similar device according to claim 1 wherein:

said flange members are spaced apart at their respective beam engaging lip ends by a distance at least as great as the outside dimension between end flanges of an associated beam.

3. A support clamp for a safety rail or similar device according to claim 1 wherein:

said web means comprises first and second separate pieces, one attached to said first flange member and the other attached to said second flange member and arranged to overlap each other; and said adjusting means comprises at least one slot in one and an aperture in the other of said separate pieces which are aligned with each other when said pieces overlap and a fastener extending through said slot and said aperture in said overlapping pieces arranged to permit movement of said separate pieces while holding said pieces in alignment.

4. A support clamp for a safety rail or similar device according to claim 3 wherein:

said adjusting means comprises a second slot and a second aperture in respective ones of said pieces aligned with each other and a second fastener extending through said second slot and aperture to permit relative movement.

5. A support clamp for a safety rail or similar device according to claim 2 wherein:

said adjusting means comprises a hinge coupled between said web means and one of said flange members for permitting movement of said one flange member toward and away from parallel relationship with the other of said flange members.

6. A support clamp for a safety rail or similar device according to claim 3 or claim 5 wherein said fastening means comprises a threaded hole through said web means and a threaded screw extending through said threaded hole towards an associated web of a beam.

7. A support clamp according to claim 4 wherein at least one of said beam engaging lips comprises an L-shaped portion adapted to wrap around the flange of an associated beam.

8. A support clamp according to claim 4 wherein at least one of said flange members further comprises a U-shaped extension for connecting said flange member to said web means, said post receiving means comprising aligned apertures in each leg of said U-shaped extension.

9. A support clamp according to claim 8 wherein each of said flange members further comprises a U-shaped extension.

10. A support clamp according to claim 8 or 9 wherein at least one of said beam engaging lips comprises an L-shaped member adapted to wrap around the flange of an associated beam.

11. A support clamp for a safety rail or similar device adapted for mounting on a beam having two end flanges and perpendicular connecting web, the clamp comprising:

first and second substantially parallel flange members spaced apart from each other, each said flange member having a beam engaging lip at one extremity thereof adapted to engage an end flange of said beam;

web means coupled between extremities of said flange members remote from their beam engaging lips;

means coupled to said web means for permitting movement of said beam engaging lips away from and toward each other so as to facilitate engagement of said lips with said beam flanges;

fastening means extending through said web means and adapted to engage the web of said beam so as to cause the end flanges of said beam to bear against at least one of said lips and thereby fasten said support clamp to said beam;

post receiving means in at least one of said flange members for supporting a post in upright relation and adjacent to said beam; and means for supporting posts received in said post receiving means on one of said flange members.

12. A support clamp for a safety rail according to claim 11, wherein said support means include protrusions upwardly extending from an internal surface of said one of said flange members and each supporting thereon a post.

13. A support clamp for a safety rail according to claim 12, wherein said adjusting means comprises a hinge coupled between said web means and one of said members for permitting movement of said one flange member toward and away from parallel relationship with the other of said flange members.

* * * * *